US007460681B2

(12) United States Patent
Geschiere et al.

(10) Patent No.: US 7,460,681 B2
(45) Date of Patent: Dec. 2, 2008

(54) RADIO FREQUENCY SHIELDING FOR RECEIVERS WITHIN HEARING AIDS AND LISTENING DEVICES

(75) Inventors: Onno Geschiere, Amsterdam (NL); Howard Nicol, Amsterdam (NL); James R. Newton, Burnsville, MN (US)

(73) Assignee: Sonion Nederland B.V., Amsterdam (NL)

( * ) Notice: Subject to any disclaimer, the term of this patent is extended or adjusted under 35 U.S.C. 154(b) by 611 days.

(21) Appl. No.: 10/894,576

(22) Filed: Jul. 20, 2004

(65) Prior Publication Data

US 2006/0018495 A1 Jan. 26, 2006

(51) Int. Cl.
*H04R 25/00* (2006.01)

(52) U.S. Cl. ..... 381/324; 381/322

(58) Field of Classification Search ..... 381/322, 381/324, 327, 328, 355, 369, 94.1, 94.5, 381/94.6; 181/158
See application file for complete search history.

(56) References Cited

U.S. PATENT DOCUMENTS 5,640,457 A * 6/1997 Gnecco et al. ..... 381/322
5,740,261 A * 4/1998 Loeppert et al. ..... 381/355
6,563,045 B2 * 5/2003 Goett et al. ..... 174/36
7,003,127 B1 * 2/2006 Sjursen et al. ..... 381/322
7,065,224 B2 * 6/2006 Cornelius et al. ..... 381/369
7,181,035 B2 * 2/2007 van Halteren et al. ..... 381/322
2002/0061113 A1 5/2002 van Halteren et al.
2004/0028251 A1 2/2004 Kasztelan et al.

* cited by examiner

*Primary Examiner*—Brian Ensey

(57) ABSTRACT

Method and apparatus are disclosed for reducing or eliminating the interference produced by a receiver in a listening device, such as a hearing aid. The method and apparatus of the invention involves placing an electrically conductive shield around the receiver. Such a shield helps suppress the electromagnetic signals emitted by the receiver, thereby reducing or eliminating the interference from the receiver. The shield is a passive shield and may be one or more wires that are wound around the receiver and shorted together, or it may be an electrically conductive mesh, jacket, sleeve, or the like, that is placed around the receiver. The shield is then connected either to one of the input terminals of the receiver, or to a system ground of the receiver.

20 Claims, 6 Drawing Sheets

RADIO FREQUENCY SHIELDING FOR RECEIVERS WITHIN HEARING AIDS AND LISTENING DEVICES

FIELD OF THE INVENTION

The present invention relates to miniature receivers used in listening devices, such as hearing aids. In particular, the present invention relates to a method and apparatus for reducing or eliminating the electromagnetic interference emitted from such miniature receivers.

BACKGROUND OF THE INVENTION

A conventional listening device such as a hearing aid includes, among other things, a microphone and a receiver. The microphone receives sound waves and converts the sound waves to an audio signal. The audio signal is then processed (e.g., amplified) and provided to the receiver. The receiver converts the processed audio signal into an acoustic signal and subsequently broadcasts the acoustic signal to the eardrum.

A receiver for a conventional listening device is shown in FIG. 1. As can be seen, the receiver 100 includes a housing 102 that protects sensitive audio signal processing circuitry inside the receiver 100. The housing 102 may be of a size and shape that allows the receiver 100 to be used in miniature listening devices, such as hearing aids. Terminals 104*a* and 104*b* located on the outside of the housing 102 allow the audio signal processing circuitry of the receiver 100 to be connected to other components in the listening device. Here, the terminal labeled 104*a* is the negative terminal which is connected to the system ground, and the terminal labeled 104*b* is the positive terminal.

A recent development in the field of listening devices in general and hearing aids in particular is the use of wireless communication. For example, it is now possible to program a listening device, such as a hearing aid, using radio frequency (RF) signals. The protocols for implementing such wireless communication are known to persons having ordinary skill in the art and will not be described here. In addition, two or more listening devices may now communicate directly with each other (e.g., for synchronization purposes) using a radio frequency link.

Listening devices such as hearing aids typically have very small batteries due to the reduced dimensions of the listening devices. Consequently, there is not a lot of power available for transmitting a radio frequency signal. The low power can result in a poor signal-to-noise ratio, which may render the listening devices extremely susceptible to interference. In some cases, even a moderate level of interference can disrupt the wireless communication, causing the programming or the synchronizing of the listening devices to fail.

One source of interference may be the receiver itself. For example, the audio signal processing circuitry in many modern receivers use a type of switching amplifier called a class D amplifier. These switching amplifiers are commonly used because they consume less power and are easier to implement than other types of amplifiers. Unfortunately, class D amplifiers are known to emit an electromagnetic signal having fundamental and harmonic frequencies that can interfere with the radio frequency signals received by the listening devices. And the housing or casing that encloses the audio signal processing circuitry is virtually transparent to the interference due to the material that it is made of. The problem is exacerbated by the close proximity of the receiver (and hence the class D amplifier) to the antenna of the listening device.

One possible solution is to provide a compensation coil around the receiver. A compensation circuit then supplies the compensation coil with a current that generates a counteracting field to the interference from the receiver. An example of this solution may be found in U.S. Published Application U.S. 20040028251 by Kasztelan et al. The Kasztelan et al. technique actively compensates for the interference by providing the compensation coil with an amplitude and phase-adjusted version of the original transmission signal. However, such a solution requires additional circuitry in the form of a compensation circuit, which makes the receiver more complex and costly to implement and occupies additional, already scarce space in the receiver.

A possible solution to the above problem is to implement some type of noise cancellation algorithm in the audio signal processing circuitry of the receiver. This solution, however, adds unwanted complexity to the operation of the listening device. And in any case, the electromagnetic signal emitted by the class D amplifier has a very unpredictable pattern, which makes it difficult to compensate for the interference using a noise canceling algorithm.

Accordingly, what is needed is a way to reduce or eliminate the interference emitted by the receiver in a listening device. Specifically, what is needed is a way to reduce or eliminate the interference in a manner that does not require any modifications to the audio signal processing circuitry of the listening device.

SUMMARY OF THE INVENTION

The present invention is directed to a method and apparatus for reducing or eliminating the interference generated by a receiver in a listening device. The method and apparatus of the invention involves placing an electrically conductive shield around the receiver. Such a shield helps suppress the electromagnetic signals emitted by the receiver, thereby reducing or eliminating the interference from the receiver. The shield is a passive shield and may be composed of one or more wires that are wound around the receiver and shorted together, or it may be an electrically conductive mesh, jacket, sleeve, or the like, that is placed around the receiver. The shield is then connected either to one of the input terminals of the receiver, or to a system ground of the receiver.

In general, in one aspect, the invention is directed to a receiver for a listening device. The receiver comprises audio signal processing circuitry configured to convert an audio signal into an acoustic signal and a housing enclosing the audio signal processing circuitry. An electrically conductive shield surrounds a substantial portion of the housing and is connected to the audio signal processing circuitry for suppressing electromagnetic emissions from the receiver in a passive manner.

In general, in another aspect, the invention is directed to a method of suppressing electromagnetic emissions from a receiver in a listening device. The method comprises the step of forming an electrically conductive shield around a substantial portion of the receiver. The electrically conductive shield is then electrically connected to the audio signal processing circuitry within the receiver to suppress the electromagnetic emissions in a passive manner.

In general, in still another aspect, the invention is directed to an electromagnetic shield for a receiver in a listening device. The electromagnetic shield comprises at least one electrically conductive wire wound into a coil substantially surrounding the receiver, and means for forming the coil into a closed electrical loop, the coil having substantially no current supplied thereto.

In general, in yet another aspect, the invention is directed to a receiver for a listening device comprising a switching amplifier. The receiver further comprises audio signal processing circuitry connected to the switching amplifier and configured to convert an audio signal into an acoustic signal. A housing encloses the audio signal processing circuitry and the switching amplifier. An electrically conductive coil surrounds a substantial portion of the housing for suppressing electromagnetic emissions from the switching amplifier in a passive manner. The electrically conductive coil forms a closed electrical circuit and is electrically connected to a system ground of the audio signal processing circuitry, and has a predetermined number of turns based on a frequency of the electromagnetic emissions to be suppressed.

The above summary of the present invention is not intended to represent each embodiment, or every aspect, of the present invention.

BRIEF DESCRIPTION OF THE DRAWINGS

The foregoing and other advantages of the invention will become apparent upon reading the following detailed description and upon reference to the drawings, wherein.

Figure 1:
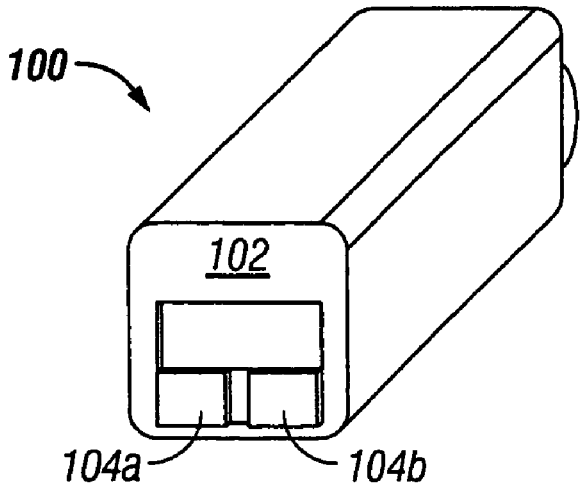
FIG. 1 (Prior Art)
FIG. 1 illustrates a prior art receiver.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DESCRIPTION OF ILLUSTRATIVE EMBODIMENTS

As mentioned above, the housing or casing that encloses most listening device receivers is virtually transparent to the electromagnetic emissions from the class D switching amplifier housed therein. Any solution involving a counteracting field or a noise cancellation algorithm would add unwanted complexity and be difficult to implement in any case because the pattern of electrical and magnetic fields emitted by the class D amplifier is unpredictable. Therefore, in accordance with the principles and teachings of the invention, an electrically conductive shield is placed over a substantial portion of the receiver housing. The electrically conductive shield helps suppress the electromagnetic signals emitted from the receiver, thereby reducing or eliminating the interference produced therefrom.

Although embodiments of the invention are discussed herein with respect to a class D switching amplifier, those of ordinary skill in the art will recognize that the invention may be applied to other types of switching amplifiers without departing from the scope of the invention.

Figure 2:
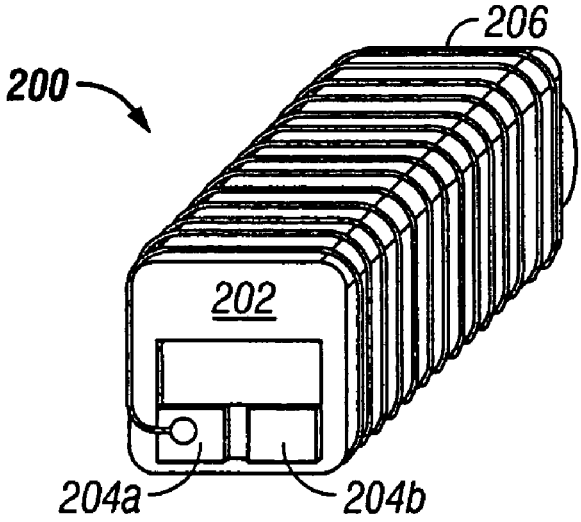
FIG. 2 illustrates a receiver according to an embodiment of the invention.

Referring now to FIG. 2, a receiver 200 according to embodiments of the invention is shown. The receiver 200 is similar to the receiver 100 shown in FIG. 1 in that it has a housing 202 and input terminals 204*a* and 204*b* located on the outside of the housing 202. In addition, the receiver 200 also has an electrically conductive shield 206 around a substantial portion of the housing 202 that helps suppress the electromagnetic signals emitted from the receiver 200. The electrically conductive shield 206, in one embodiment, is composed of one or more electrically conductive wires that have been shorted together to form a closed electrical loop. The shield 206 is then electrically connected to one of the input terminals 204*a* or 204*b*, preferably the negative input terminal 204*a*, which is also connected to the system ground 208. Such a shield 206 is considered to be a passive shield in that it simply suppresses the interference from the receiver 200 as opposed to counteracting the interference. As a result, the shield 206 is far less complex and easier to implement than solutions that try to counteract the interference.

Where the shield 206 is composed of one or more electrically conductive wires, the wires may be wound around the housing 202 in series or in parallel with each other, or a combination of both. The one or more electrically conductive wires may also be wound around the housing 202 in a clockwise or a counterclockwise direction relative to the input terminals 204*a* and 204*b*. The size or gauge of the wires may vary, for example, from 0.05 to 0.10 mm. Similarly, the number of turns or windings of wires may vary between 8 to 45 turns based on the frequency of the interference signal to be suppressed.

Figure 3:
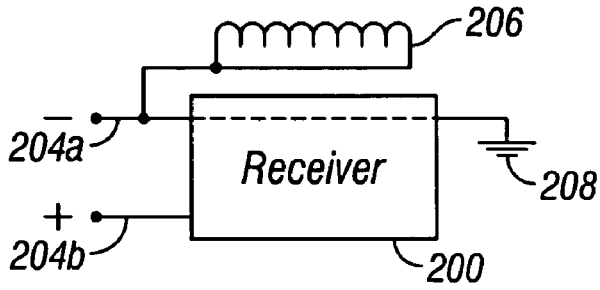
FIG. 3 illustrates a schematic diagram of the embodiment shown in FIG. 2.

FIG. 3 shows a schematic diagram of the arrangement in FIG. 2. As can be seen, the receiver 200 has two input terminals 204*a* and 204*b* that allow the audio signal processing circuitry of the receiver to be connected to other components in the listening device. The shield 206 is then connected to one of input terminals 204*a* and 204*b*, preferably the negative input terminal 204*a*, and shorted together to form a closed electrical loop.

Figure 4:
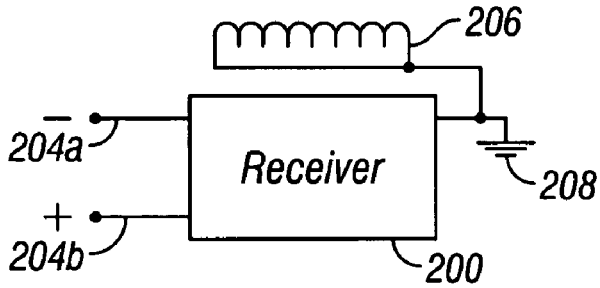
FIG. 4 illustrates a schematic diagram of a variation of the embodiment shown in FIG. 2.

FIG. 4 shows a variation of the arrangement in FIGS. 2 and 3. In FIG. 4, neither one of the input terminals 404*a* and 404*b* are connected to the system ground. This type of arrangement is referred to as an unbalanced system and allows for doubling of the input voltage across the input terminals 404*a* and 404*b*. In such an arrangement, the shield 206 is not connected to either input terminals, but is directly connected to the system ground 208, which is electrically connected to the audio signal processing circuitry.

Figure 5:
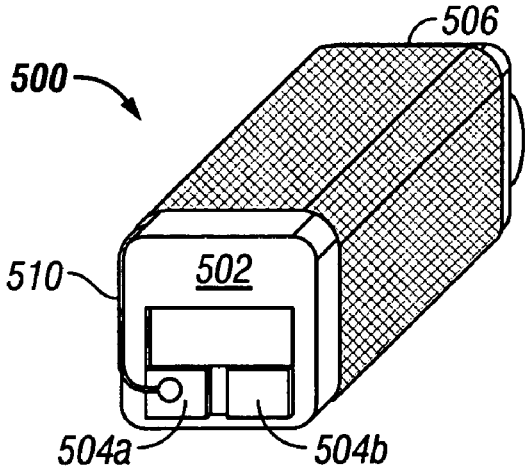
FIG. 5 illustrates a receiver according to another embodiment of the invention.

In some embodiments, instead of one or more electrically conductive wires, the shield may instead be implemented as an electrically conductive mesh, jacket, or sleeve. Such an arrangement is shown in FIG. 5 (also called a "solid" shield). As can be seen, the receiver 500 is similar to the receiver 200 described in FIG. 2 in that it has a housing 502 and input terminals 504*a* and 504*b*. However, the shield 506 has been implemented as an electrically conductive mesh, jacket, or sleeve instead of the one or more wires described previously. The mesh, jacket, or sleeve may then be connected to one of the input terminals 504*a* and 504*b*, for example, by a short wire 510. Such a mesh, jacket, or sleeve has essentially the same effect of suppressing the interference signals from the receiver as the one or more electrically conductive wires.

In one experiment, it was shown that suppression of up to 10 dB for frequencies from 100 kHz to 15 MHz is possible using the present invention. Importantly, the experiment showed that a shield according to embodiments of the invention does not significantly affect (i.e., neither improved nor deteriorated) the audio frequency magnetic radiation of the receiver. For an unbalanced system where neither one of the input terminals of the receiver are grounded, the greatest effectiveness was achieved when the shield is grounded. When the shield is ungrounded (i.e., floating), the bandwidth suppressed was limited to about 2 MHz. It was also observed that a shield composed of coils was about 10 dB more effective than a solid shield (e.g., a brass sleeve) when the antenna is very close to the receiver.

The experiment itself was conducted using an Advantest model R3265A spectrum analyzer and a Hewlett-Packard model HP-33120A function generator. Audio frequency measurements were performed using a Rohde & Schwarz UPL Audio Analyser DC-10 KHz and a telecoil. The radio frequency measurements were performed on an air-coil antenna placed at about 8 mm from the middle of the receiver and wound on a sleeve. The receiver was driven from the function generator at 5 V peak-to-peak and placed on a 40 mm turntable in order to determine polar patterns. Other factors affecting the experiment include the fact that the 1 kHz impedance of the receiver used for the experiment is 200 ohms, and that all coil-based shields were shorted to the negative terminal of the receiver. Some of the results from the experiment are described below.

Figure 6:
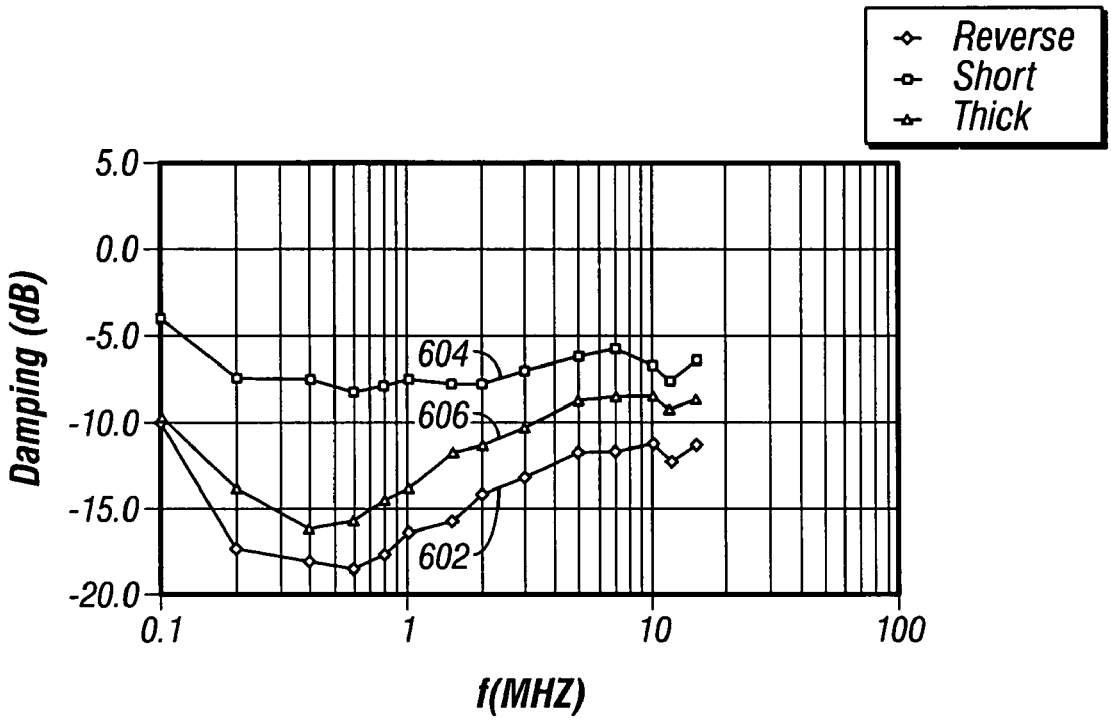
FIG. 6 illustrates a graph of the interference suppression capability of the receiver with respect to frequency according to embodiments of the invention.

One purpose of the experiment was to determine the amount of dampening that can be achieved versus frequency. A graph showing dampening in dB versus frequency for a coil-based shield can be seen in FIG. 6. In the graph, the line labeled 602 represents a coil that is wound in a counterclockwise direction, the line labeled 604 represents a short coil, i.e., one that has few turns (e.g., about 8 turns), and the line labeled 606 represents a coil made of one or more thick wires (e.g., about 0.15 mm). The antenna coil is positioned in front of the receiver at a distance of 8 mm to the middle of the receiver. As can be seen, the dampening is at a maximum around 500 kHz. The fact the short coil design has a much flatter response indicates that the size and number of turns of the shield may be used to tune the effectiveness of the shield in a certain frequency range.

Figure 7A:
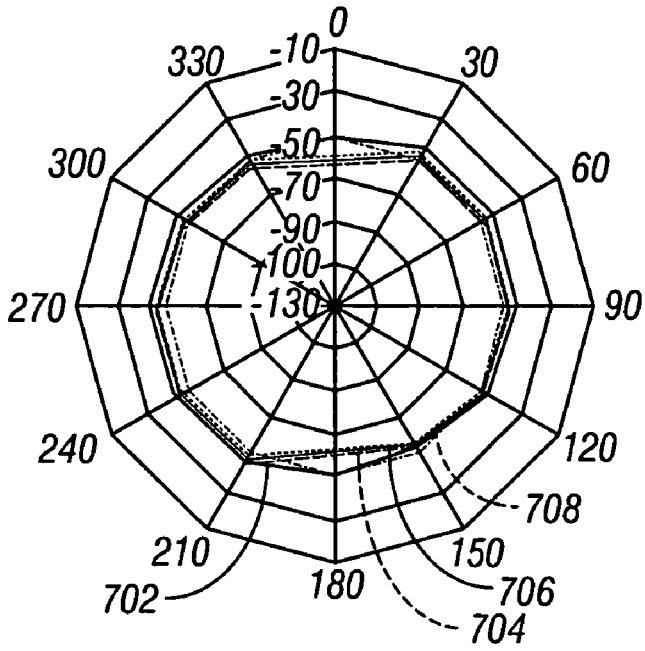
FIGS. 7A-7B illustrate polar charts of the directionality of the receiver at audio frequencies according to embodiments of the invention.
Figure 7B:
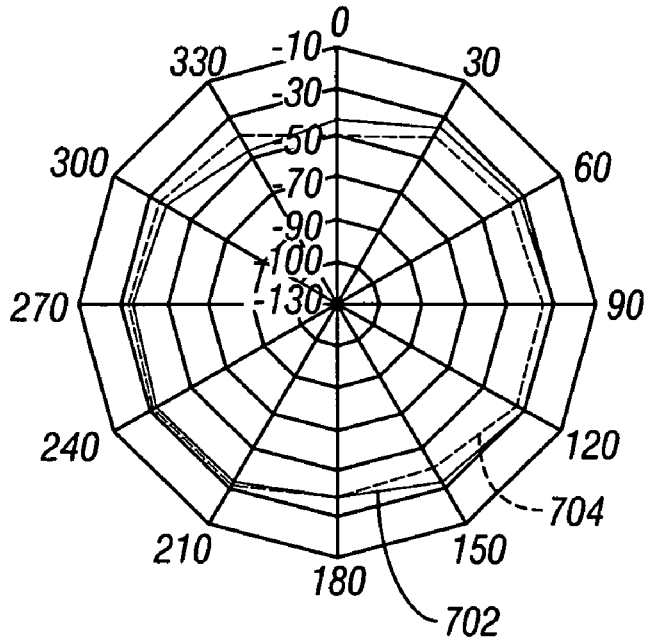

FIGS. 7A and 7B are polar charts showing the effects of the coil-based shield on the directionality of the receiver in the audio frequency range. FIG. 7A illustrates the results at 500 Hz and FIG. 7B illustrates the results at 10 kHz. In the charts, the line labeled 702 represents the case wherein no shield is used, the line labeled 704 represents a coil made of one or more thin wires (e.g., about 0.05 mm), the line labeled 706 represents a coil made of one or more thick wires (e.g., about 0.15 mm), and the line labeled 708 represents a coil that it is wound in a counterclockwise direction relative to the input terminals. As can be seen in both charts, in the audio frequency range, there is virtually no impact to the receiver as a result of the shield.

Figure 8A:
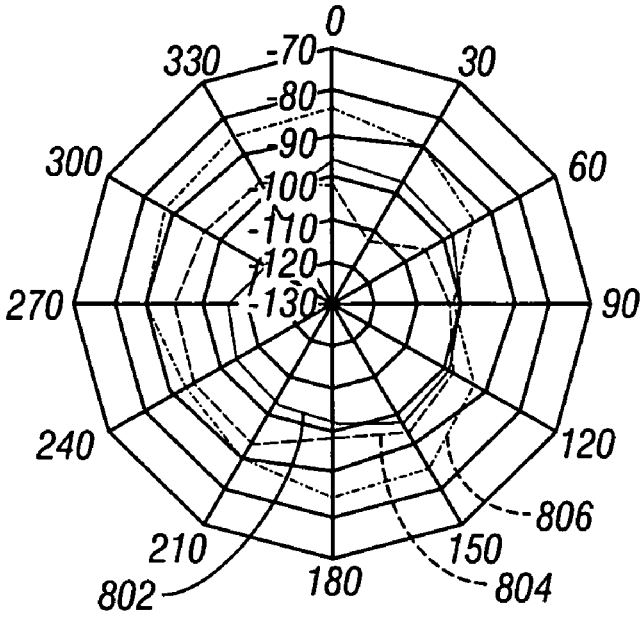
FIGS. 8A-8B illustrate polar charts of the directionality of the receiver at radio frequencies according to embodiments of the invention.
Figure 8B:
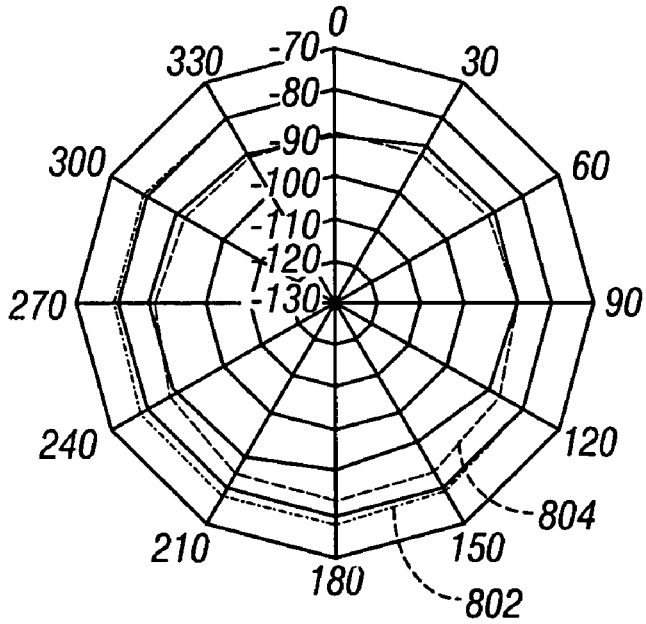

FIGS. 8A and 8B are polar charts showing the effects of the coil-based shield on the directionality of the receiver in the radio frequency range. FIG. 8A illustrates the results at 630 kHz with the antenna located at about 8 mm from the shield, and FIG. 8B illustrates the results at 3 MHz for the same distance. In the charts, the line labeled 802 represents the case wherein no shield is used, the line labeled 804 represents a coil that it is wound in a counterclockwise direction (relative to the input terminals), and the line labeled 806 represents a mesh/jacket/sleeve based shield that is grounded. As can be seen, the directionality of both the coil-based shields and the mesh/jacket/sleeve based shield is dependent on the frequency. These results indicate that the functionality of the shielding depends on the direction from or angle under which the RF signals reach the receiver.

Figure 9:
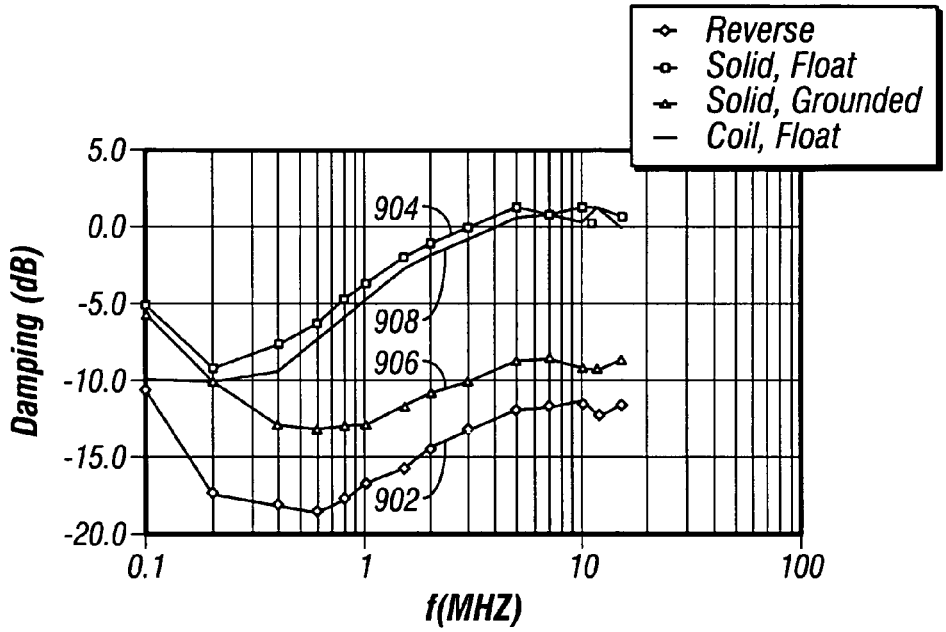
FIG. 9 illustrates the suppression capability of the receiver when grounded versus ungrounded according to embodiments of the invention.

The experiment described thus far has used shields that were grounded, but shields that are ungrounded (i.e., floating) may also be used. FIG. 9 illustrates the dampening capability of the shield versus frequency for grounded and ungrounded shields. In the graph shown in FIG. 9, the line labeled 902 represents a coil-based shield that is wound in a counterclockwise direction, the line labeled 904 represents a mesh/jacket/sleeve based shield that is ungrounded, the line labeled 906 represents the same shield, but grounded, and the line labeled 908 represents a coil-based shield that is ungrounded. As can be seen, without grounding, the bandwidth of the frequencies that can be effectively dampened by the shield is limited to only about 2 MHz. Thus, it can be concluded that, although an ungrounded shield will suffice for certain frequencies, a grounded shield is more effective overall.

Figure 10:
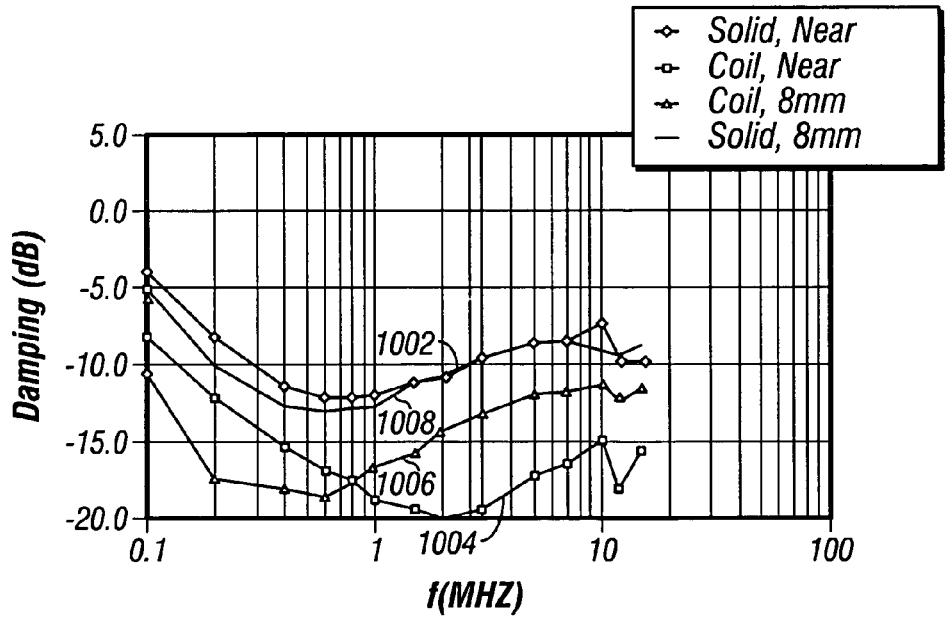
FIG. 10 illustrates the influence of distance on the receiver according to embodiments of the invention.

Most of the measurements discuss above were made with the antenna located at a distance of about 8 mm from the middle of the receiver. In real world listening devices, the distance between the antenna and the receiver may often be less. FIG. 10 illustrates the dampening capability of the shield versus frequency when the antenna is located at about 8 mm from the receiver and when it is located less than 8 mm from the receiver. In the graph shown in FIG. 10, the line labeled 1002 represents a mesh/jacket/sleeve based shield wherein the antenna is located less than 8 mm from the receiver, the line labeled 1004 represents a coil-based shield wherein the antenna is located less than 8 mm from the receiver, the line labeled 1006 represents a coil-based shield wherein the antenna is located about 8 mm from the receiver, and the line labeled 1008 represents a mesh/jacket/sleeve based shield wherein the antenna is again located about 8 mm from the receiver. As can be seen, a coil-based shield wherein the antenna is located less than 8 mm from the receiver is much more effective then the other shields, especially in the range of 1 to 10 MHz.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A receiver for a listening device, comprising:

audio signal processing circuitry configured to convert an audio signal into an acoustic signal;

a housing enclosing said audio signal processing circuitry; and an electrically conductive shield surrounding a substantial portion of said housing, said electrically conductive shield electrically connected to said audio signal processing circuitry for suppressing electromagnetic emissions from said receiver in a passive manner.

2. The receiver according to claim 1, wherein said electrically conductive shield is electrically connected to an input terminal of said audio signal processing circuitry.

3. The receiver according to claim 2, wherein said input terminal is located externally to said housing.

4. The receiver according to claim 2, wherein said input terminal is a system ground of said audio signal processing circuitry.

5. The receiver according to claim 1, wherein said electrically conductive shield is composed of a magnetically conductive material.

6. The receiver according to claim 1, wherein said electrically conductive shield is composed of at least one electrically conductive wire wound around said housing and forming a closed electrical loop.

7. The receiver according to claim 6, wherein said at least one electrically conductive wire is wound around said housing in a clockwise direction relative to said input terminal.

8. The receiver according to claim 6, wherein said at least one electrically conductive wire is wound around said housing in a counter-clockwise direction relative to said input terminal.

9. The receiver according to claim 6, wherein said at least one electrically conductive wire is wound around said housing a predetermined number of turns based on a frequency of said electromagnetic emissions to be suppressed.

10. The receiver according to claim 1, wherein said receiver is an unbalanced receiver and said audio signal processing circuitry has input terminals that are not grounded, said electrically conductive shield connected to said audio signal processing circuitry through a system ground of said receiver.

11. The receiver according to claim 9, wherein said receiver further includes a switching amplifier connected to said audio signal processing circuitry.

12. A method of suppressing electromagnetic emissions from a receiver in a listening device, comprising:

forming an electrically conductive shield around a substantial portion of said receiver; and electrically connecting said electrically conductive shield to audio signal processing circuitry within said receiver;

wherein said electrically conductive shield suppresses said electromagnetic emissions in a passive manner.

13. The method according to claim 12, wherein said electromagnetic emissions include radio frequency emissions and harmonics thereof

14. The method according to claim 12, wherein a bandwidth of said electromagnetic emissions that are being suppressed is greater than 2 MHz.

15. The method according to claim 12, wherein said electromagnetic emissions are suppressed by at least ten decibels.

16. The method according to claim 12, wherein audio frequency emissions are substantially unaffected.

17. The method according to claim 12, wherein said step of forming an electrically conductive shield includes winding at least one electrically conductive wire around said receiver and forming a closed electrical loop.

18. The method according to claim 12, wherein said step of forming an electrically conductive shield includes winding at least one electrically conductive wire into a coil and forming a closed electrical loop, then placing said receiver within said coil.

19. An electromagnetic shield for a receiver in a listening device, comprising:

at least one electrically conductive wire wound into a coil substantially surrounding said receiver; and means for forming said coil into a closed electrical loop, said coil having substantially no current supplied thereto; and means for electrically connecting said coil to audio signal processing circuitry within said receiver.

20. A receiver for a listening device, comprising:

a switching amplifier;

audio signal processing circuitry connected to said switching amplifier and configured to convert an audio signal into an acoustic signal;

a housing enclosing said audio signal processing circuitry and said switching amplifier; and an electrically conductive coil surrounding a substantial portion of said housing for suppressing electromagnetic emissions from said switching amplifier in a passive manner, said electrically conductive coil forming a closed electrical circuit and electrically connected to a system ground of said audio signal processing circuitry, said electrically conductive coil having a predetermined number of turns based on a frequency of said electromagnetic emissions to be suppressed.

* * * * *